United States Patent [19]

Leitch

[11] 4,236,042

[45] Nov. 25, 1980

[54] COMPATIBLE AM STEREO SYSTEM EMPLOYING A MODIFIED QUADRATURE MODULATION SCHEME

[75] Inventor: Clifford D. Leitch, Quincy, Ill.

[73] Assignee: Harris Corporation, Cleveland, Ohio

[21] Appl. No.: 19,837

[22] Filed: Mar. 12, 1979

Related U.S. Application Data

[63] Continuation of Ser. No. 812,657, Jul. 5, 1977, abandoned.

[51] Int. Cl.[3] ..... H04H 5/00

[52] U.S. Cl. ..... 179/1 GS; 329/50; 332/40; 455/117

[58] Field of Search ..... 179/1 GS; 325/36, 46, 325/150, 187; 329/50, 167; 332/40, 41, 42, 48; 455/102, 117

[56] References Cited

U.S. PATENT DOCUMENTS

| | | | |
|---|---|---|---|
| 1,666,158 | 4/1928 | Affel | 179/1 GS |
| 2,903,518 | 9/1959 | Kahn | 179/1 GS |
| 3,102,167 | 8/1963 | Barton | 179/1 GS |
| 3,109,896 | 11/1963 | Boothroyd | 179/1 GS |
| 3,128,345 | 4/1964 | Freedman et al. | 179/1 GS |
| 3,137,816 | 6/1964 | Mc Lin et al. | 179/1 GS |
| 3,217,105 | 11/1965 | Barton | 179/1 GS |
| 3,231,672 | 1/1966 | Collins et al. | 179/1 GS |
| 3,732,375 | 5/1973 | Kuribayashi | 179/1 GS |
| 3,936,594 | 2/1976 | Schubin et al. | 179/1 GS |

OTHER PUBLICATIONS

*RCA Review,* Sep. 1960, pp. 299–359.

*Primary Examiner*—Douglas W. Olms

[57] ABSTRACT

A compatible AM stereo system including a modified quadrature modulation scheme. Two stereo modulators are described which each generate composite modulated signals including a carrier component and two phase-shifted components. The two phase-shifted components, corresponding to the left (L) and right (R) source signals, are phase shifted by equal phase angles $\theta$ on either side of the carrier, where $\theta$ is between 10° and 20°. A limiter is included which operates to limit the magnitude of the source signals supplied by the stereo modulator. The limiter allows each source signal to contribute up to 80% of the total modulation, as long as total modulation constraints are not exceeded due to the combined amplitudes of the two source signals. A receiver is described for demodulating the composite modulated signal.

22 Claims, 5 Drawing Figures

COMPATIBLE AM STEREO SYSTEM EMPLOYING A MODIFIED QUADRATURE MODULATION SCHEME

This is a continuation, of application Ser. No. 812,657 filed July 5, 1977, now abandoned.

BACKGROUND AND FIELD OF THE INVENTION

The present invention relates to stereophonic broadcasting, and more particularly to a compatible AM stereo system employing a modified quadrature modulation scheme.

The broadcasting community has long sought an acceptable system for transmitting and receiving stereophonic signals in the AM frequency band. To be acceptable, any proposed system must be capable of providing good stereo performance while still being compatible for use with currently available (monophonic) AM receivers. This problem has undergone extensive investigation and many systems have been proposed which meet the above criterion with greater or lesser degrees of success. Since each of these systems has also included undesirable features, however, none has yet met with general acceptance.

Preferably, the stereophonic performance of an acceptable AM stereo system should be such that the signal-to-noise ratio is not significantly degraded as compared to that reception obtainable with current systems. Also, distortion introduced by the transmission and reception of the stereo signal should be minimal. Finally, the separation between the left and right channels should be as great as possible.

With respect to mono-compatibility, any acceptable AM stereo system must be fully compatible with receivers currently on the market. More specifically, no noticeable distortion should be introduced through the detection of the stereo signals with the monophonic envelope detectors and product detectors currently in use. Additionally, the loss in the loudness of the received signal in monophonic receivers due to the stereophonic nature of the broadcast signal should be as low as possible.

The present invention provides a compatible AM stereo system which closely meets all of these requirements. There is disclosed herein a modified quadrature modulation scheme wherein the phase angle between the left (L) and right (R) vector components of the composite stereo AM signal is reduced from the standard 90° (±45° with respect to the carrier) employed in quadrature modulation, to a much narrower angle, nominally equal to 30° (±15° with respect to the carrier). As will be made clearer hereinafter, this system could equivalently be viewed as involving the weighting of the in-phase (L+R) and the quadrature phase (L−R) components of a standard quadrature modulated signal by factors of Cos $\theta$ and Sin $\theta$, respectively, where $\theta$ is again nominally equal to 30°.

Systems have been proposed in the past wherein quadrature modulation schemes were utilized specifying modulation angles of less than 90°. The patent to Collins No. 3,231,672, for example, specifies a modulation angle within the range of 55° and 75°, whereas the patent to Barton Pat. No. 3,102,167 specifies an angle within the range of 50° to 60°. It has been found in practice that the performance provided by systems employing angles within these ranges is unacceptable.

Rather, a compatible AM stereo system may only be provided if modulation angles within the range of 20° to 40°, preferably 30° (±15° with respect to the carrier) are employed. When modulation angles within this range are utilized in the schemes set forth in this disclosure, it has been found that excellent mono-compatibility and stereo performance result.

Furthermore, stereo modulation systems are disclosed herein which employ limiting circuits providing input signal limiting in such a manner that signal-to-noise characteristics are enhanced. The limiting circuits are designed to allow each input signal to exceed the amplitude which would produce 50% modulation of the transmitting signal, as long as total modulation constraints are not exceeded.

In accordance with the present invention, an AM stereo modulation system is provided which comprises a source of a carrier signal, and a stereo modulator which modulates the carrier signal in accordance with first and second source signals to provide a composite modulated signal having two phase components, the amplitudes of each of which are modulated in accordance with a corresponding one of the source signals, with the phase components being phased at equal phase angles on either side of the carrier signal by an angle of no greater than 20° and no less than 10°.

In accordance with another aspect of the present invention, a limiting circuit is provided for applying amplitude constraints to the first and second source signals so as to supply the stereo modulator with amplitude limited source signals. The limiting circuit includes an individual input channel limiter for preventing the amplitude of each of the source signals from exceeding a selected level corresponding to at least 60% but no greater than 90% of the amplitude necessary to provide 100% modulation of the carrier signal, and a total modulation of the carrier signal from exceeding selected total modulation constraints.

Also in accordance with the present invention, an AM stereo demodulator is disclosed for demodulating the composite modulated signal. A quadrature demodulator responds to the composite modulated signal to recover in-phase and quad-phase components therefrom. The relative amplitudes of the recovered components are corrected in accordance with the tangent of the phase angle $\theta$ by which each of the two phase components carrying the source signals is shifted with respect to the carrier. A matrix circuit adds and subtracts the amplitude adjusted signals from one another so as to thereby recover the two source signals.

BRIEF DESCRIPTION OF THE DRAWINGS

The foregoing and other objects and advantages of the present invention will become more readily apparent from the following description of a preferred embodiment, as taken in conjunction with the accompanying drawings, which are a part hereof and wherein.

DETAILED DESCRIPTION OF THE DRAWINGS

Figure 1:
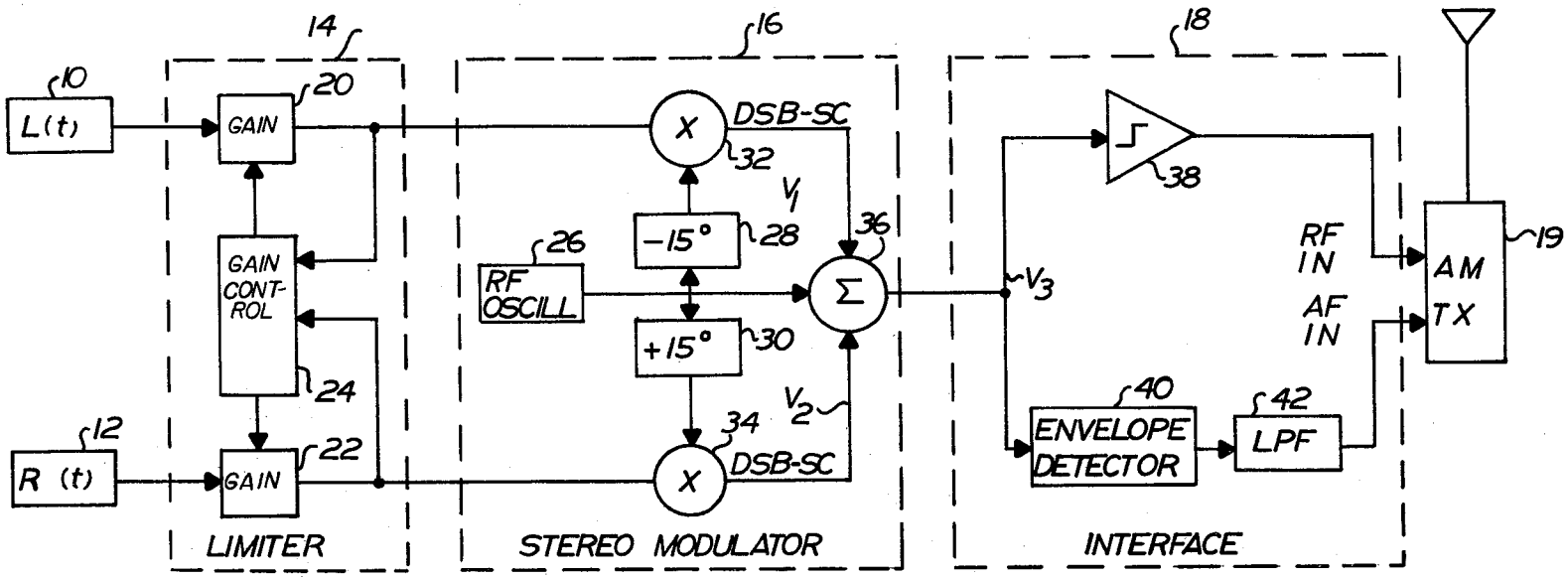
FIG. 1 is a block diagram of one embodiment of a transmitter system employing a modulation scheme in accordance with the present invention.

There is illustrated in FIG. 1 a transmitting system for modulating the left and right audio signals onto an RF carrier signal in accordance with the modified quadrature modulation scheme disclosed herein. In this embodiment, left and right signal sources 10 and 12 provide audio signals to a limiter 14 which limits the amplitude of the audio signals in accordance with limiting constraints which will be described in greater detail hereinafter. The amplitude limited audio signals are supplied to a stereo modulator 16 which modulates an Rf carrier signal in accordance therewith. The composite modulated signal generated by modulator 16 is directed to a transmitter interface 18 which interfaces the signal with a conventional AM transmitter 19.

As indicated generally in FIG. 1, limiter 14 includes a voltage variable gain stage 20 and 22 for each audio channel. These gain circuits are controlled by a gain control circuit 24 which will be described hereafter with reference to FIG. 3.

Stereophonic modulator 16 includes an RF oscillator 26 which provides an output signal serving as the carrier signal for the transmitting system. This carrier signal is directed through two phase delays 28 and 30 which respectively provide phase shifted carrier signals which are advanced and delayed, respectively, by equal phase angles $\theta$ (illustrated as 15°) with respect to the carrier signal supplied by RF oscillator 26. These phase adjusted carrier signals are directed to respective double sideband, suppressed carrier (DSB-SC) modulators 32 and 34 which each modulate the corresponding carrier signal in accordance with the corresponding signal supplied by audio signal source 10 or 12. In this manner, two modulated signals are provided which are phased at $\pm\theta$ with respect to the carrier signal supplied by the RF oscillator. The two DSB-SC signals generated by modulators 32 and 34 are directed to a summing circuit 36 which additively combines these signals with the carrier signal supplied by the RF oscillator so as to provide a composite stereo signal including a carrier signal and two phase components for transmission over an RF broadcast channel.

In order that this composite modulated signal, which includes both phase and amplitude variation, may be transmitted through use of a conventional AM transmitter, a transmitter interface 18 is provided. This interface circuit serves to separate the modulated (RF) signal into phase and amplitude components. The phase component is derived by hard limiting the modulated signal with a hard-limiting circuit 38 so as to provide an RF signal having a phase component which corresponds to that of the modulated signal but which has constant amplitude. This amplitude-limited RF signal is directed to the RF input to the conventional AM transmitter 19. The envelope function is detected by means of an envelope detector 40 of conventional design. The envelope signal developed by envelope detector 40 is directed through a low-pass filter 42 so as to provide an audio frequency signal which corresponds to the envelope function of the composite modulated signal. This signal will be supplied to the audio input of the conventional AM transmitter 19.

The operation of the stereo AM transmitting system of FIG. 1 may be more clearly understood through consideration of the following mathematical description thereof.

The output of modulators 32 and 34, corresponding to the two phase components of the composite modulated signal, may be defined as:

$$V_1 = L(t)\ \mathrm{Cos}\ (\omega_c t - \theta) \tag{1}$$

$$V_2 = R(t)\ \mathrm{Cos}\ (\omega_c t + \theta) \tag{2}$$

The output of summer 32 is therefore:

$$V_3 = L(t)\ \mathrm{Cos}\ (\omega_c t - \theta) + R(t)\ \mathrm{Cos}\ (\omega_c t + \theta) + \mathrm{Cos}\ \omega_c t \tag{3}$$

By expanding the two cosine terms and collecting like terms, we get:

$$V_3 = [1 + (L+R)\ \mathrm{Cos}\ \theta]\ \mathrm{Cos}\ \omega_c t + [(L-R)\ \mathrm{Sin}\ \theta]\ \mathrm{Sin}\ \omega_c t \tag{4}$$

It is thus seen that the transmitting system of FIG. 1 is the equivalent of a quadrature modulation scheme where the in-phase (Cos $\omega_c$t) and quad-phase (Sin $\omega_c$t) terms are "weighted" by terms of Cos $\theta$ and Sin $\theta$, respectively.

Figure 2:
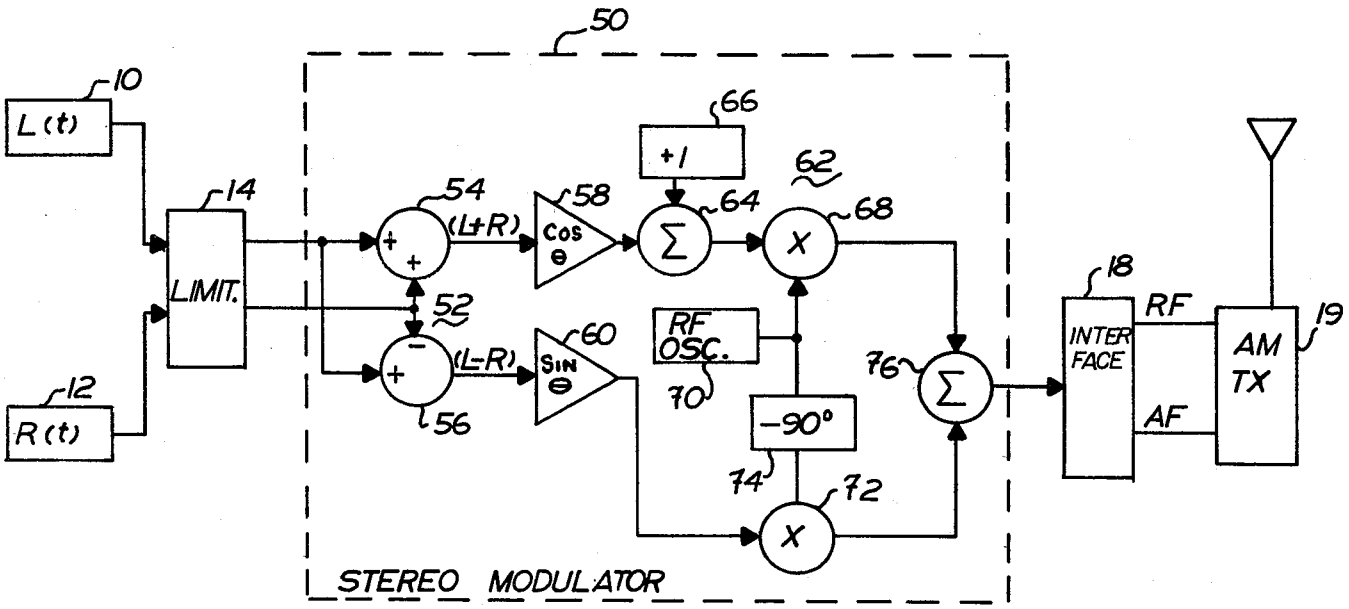
FIG. 2 is a block diagram of a second embodiment of a transmitting system employing a different stereo modulator which is equivalent to the one used in the embodiment shown in FIG. 1.

The stereo modulator 50 illustrated in FIG. 2 provides essentially a direct implementation of the modulation fuction described by Equation 4. In this embodiment (wherein elements corresponding to similar elements of FIG. 1 are denoted by corresponding reference numerals), the amplitude limited left and right audio signals are first directed through an audio matrixing circuit 52. Audio matrixing circuit 52 includes a signal summer 54 and a signal subtractor 56; these circuits combine the left and right audio signals so as to respectively provide sum (L+R) and difference (L−R) output signals. These signals are directed to scaling circuits 58 and 60 which provide weighting of the (L+R) and (L−R) components by factors of Cos $\theta$ and Sin $\theta$ respectively. The output of scaling circuit 58 is then directed to an AM modulator 62 which modulates a carrier signal in accordance with conventional AM techniques. For purposes of illustration, modulator 62 is pictured as comprising a summing circuit 64 which sums the output of scaling circuit 58 with a DC component supplied by a circuit 66. This DC component has a magnitude corresponding to the maximum permissible amplitude of the (L+R) signal so that the output of summer 64 constitutes what may be referred to as a "raised" audio signal. A balanced modulator 68 responds to the raised audio signal and to a carrier signal supplied by RF oscillator 70 so as to supply a conventional AM signal at the output thereof. This AM signal represents the in-phase component of the transmitted signal.

The output of scaling circuit 60 is directly supplied to the modulating input of another balanced modulator 72 which provides a double sideband, suppressed carrier output since this audio signal has not been DC level adjusted in the manner of the in-phase component. A quadrature-phase carrier signal (Sin $\omega_c$t) is supplied to modulator 72 via a 90° phase shifter 74. The output of modulator 72 thus represents a quadrature-phase component of the transmitted signal. The in-phase and quad-phase components supplied by modulator 68 and 72 are supplied to a summing circuit 74 which combines them to provide the composite modulated signal, having the form described by Equation 4.

As in the previous embodiment, the modulated signal will then be separated into phase and amplitude components by an interface circuit 18. The amplitude and phase components of the modulated signal are used to drive a conventional AM transmitter 19.

Although the modulating systems illustrated in FIGS. 1 and 2 take different forms, they are equivalent in the sense that the composite modulated signals supplied thereby are identical. More specifically, both circuits provide composite modulated signals having a carrier component and two phase-shifted components, phased equal amounts $\theta$ on either side of the carrier signal.

Although the weighting factors of FIG. 2 (or, equivalently, the phase shifting factors of FIG. 1) could be selected to comprise any angle between 0° and 90°, only a very narrow range of angles exist which may be used to provide an acceptable compatible AM stereo system. The allowable range of angles is essentially dictated in compliance with two competing constraints; signal-to-noise ratio in stereophonic reception and compatibility with conventional monophonic envelope detectors.

Figure 4:
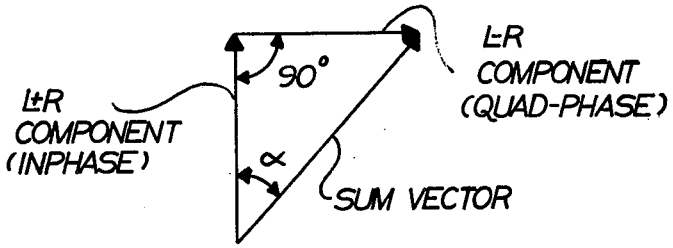
FIG. 4 is a vector diagram useful in understanding the present invention; and, FIG. 5 is a block diagram of a receiving system for receiving the modulated signal generated by either of the transmitting systems illustrated in FIGS. 1 and 2.

Two methods, envelope detection and product detection, are commonly used for detection of monophonic AM signals. A product detector essentially provides amplitude detection of only the in-phase components of the signal being processed. Since the in-phase component of the composite modulated signal generated by the stereo modulators of FIGS. 1 and 2 will always correspond to the "mono" (L+R) part of the signal, no distortion will be produced in a product detector regardless of the modulation phase angle $\theta$ employed. An envelope detector, however, will respond to the entire envelope function. As can be seen more clearly through reference to the vector diagram of FIG. 4, the envelope function (corresponding to the amplitude of the sum vector) will depend upon the amplitude of both in-phase and quad-phase components. More specifically, the sum vector, which may be visualized as the hypotenuse of a right triangle, is characterized by an amplitude of:

$$\text{Magnitude} = \sqrt{[1 + (L + R)\cos\theta]^2 + [(L - R)\sin\theta]^2} \quad (5)$$

at a phase angle of:

$$\alpha = \arctan\left[\frac{(L - R)\sin\theta}{1 + (L + R)\cos\theta}\right] \quad (6)$$

True mono-compatibility, however, implies that the envelope function be as close to the monophonic AM case (envelope=1+(L+R)) as possible. Equation 5 will, of course, reduce to this case as the phase angle $\theta$ approaches zero. For larger $\theta$'s, however, the Sin $\theta$ term becomes more dominate and adds increasing amounts of distortion to the envelope function. Although the maximum amount of distortion occurs at $\theta=90°$, unacceptable levels of distortion are introduced at much smaller phase angles. In this regard, the threshold of "unacceptable" distortion corresponds to approximately 3.3% RSS distortion, which investigators have found to represent the threshold of objectionable distortion to critical listeners in a system having an audio bandwidth of 10 kHz. In order to achieve this low level of distortion the phase angle must be quite small. Where modulation provided by either L or R channel is limited to no greater than 50% of the total modulation, worst case distortion occurs when both channels are at full (i.e., 50% of total) modulation. In this case, the distortion varies with phase angle as indicated below.

TABLE I

| | PHASE ANGLE $\theta$ | | | |
|---|---|---|---|---|
| | ±15° | ±25° | ±30° | ±37.5° |
| RSS Distortion | 1.8% | 5.1% | 7.5% | 12.0% |
| SNR | −12dB | −8.3dB | −7.3dB | −6.3dB |

As can be seen from this table, acceptable distortion (i.e., less than 3,3%) only occurs at phase angles smaller than a threshold phase angle of somewhere between ±15° and ±25°. Distortion levels at $\theta \geqq \pm 25°$ are clearly to large.

Signal-to-noise considerations in stereophonic reception, however, are a competing constraint since signal-to-noise ratio is greater at large phase angles, and becomes progressively worse at smaller phase angles. This can be seen in TABLE I, where signal-to-noise ratio (SNR) is expressed in terms of dB below SNR for mono-reception at 100% modulation. Consequently, although distortion is much reduced at values of $\theta$ less than ±15°, signal-to-noise ratio at these angles is undesirably high. From these considerations it follows that the phase angle $\theta$ must be selected to be somewhere in the proximity of 15°. Optimum performance is provided for phase angles within the range of ±10° to ±20°. Larger phase angles will produce unacceptable levels of distortion, while smaller phase angles will produce unacceptable deterioration of the signal-to-noise ratio. The signal-to-noise ratio loss at $\theta=\pm 15°$, while still somewhat high, nonetheless compares favorably with the −17 dB loss in SNR experienced in conventional FM stereo broadcasting.

It has been found that signal-to-noise ratio for stereo reception can be improved for small phase angles by allowing either of the input source signals (i.e., the L and R signals in the illustrated embodiment) to exceed the 50% modulation level when smaller signals are present in the other channel. Thus, for example, when the left channel alone is being supplied with a signal, this signal is allowed to provide up to 80% of the total allowable modulation of the composite modulated signal, as opposed to the 50% which would normally be provided. Since the total modulation should not exceed the 100% modulation level, however, two sets of limiting functions must be applied to the incoming signals. These two constraints will hereafter be referred to as individual channel constraints and total modulation constraints.

Figure 3:
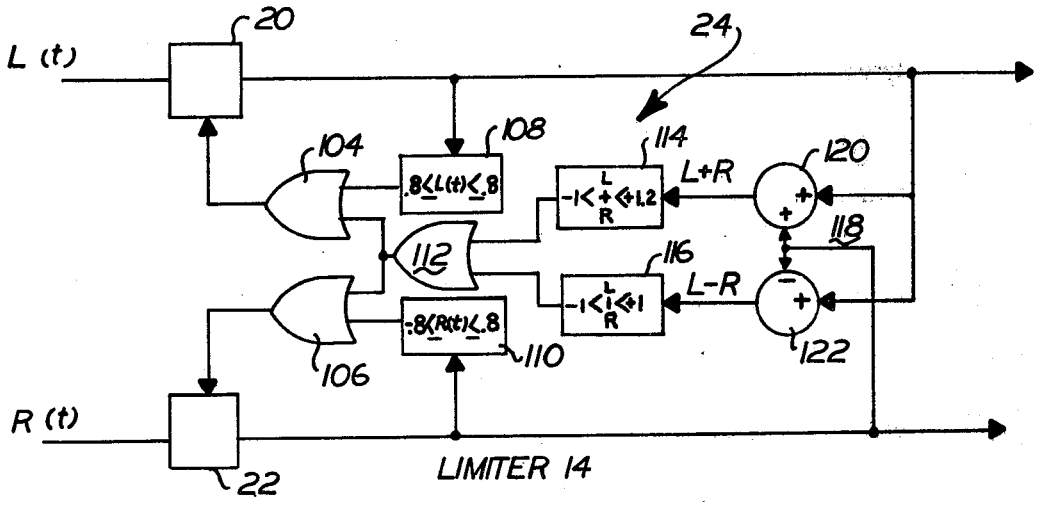
FIG. 3 is a block diagram of a limiter which may be used in the transmitting systems of FIGS. 1 and 2.

A limiting circuit for providing this function is illustrated in FIG. 3. In this FIGURE it will be seen that the left and right channels are both supplied with a voltage controlled gain element 20 and 22. As stated previously, these gain circuits (which may, for example, comprise conventional four-quadrant analog multipliers) are controlled by a gain control circuit 24.

Each gain element 20 and 22 may receive an analog control voltage from one of two sources. The two analog control voltages (corresponding to the individual channel constraints and the total modulation constraints) are selectively gated by circuits which are characterized in the FIGURE as logic OR gates 104 and 106. As will be apparent to those skilled in the art, OR gates 104 and 106 will not actually comprise digital logic circuits in the conventional sense, because a gating of analog signals is required. These circuits may instead each comprise a conventional diode gating network operative to gate the smaller of the two input signals to the corresponding gain element.

One input of each OR gate 104 and 106 is derived from a threshold circuit 108 and 110 which monitors the individual channel amplitude. If the amplitude of one of the source signals were to exceed the individual channel constraints, the output of the corresponding threshold detector would very rapidly decrease in amplitude. Assuming total modulation constraints have not been exceeded, this decrease in amplitude will be reflected by a decrease in the amplitude of the control signal supplied to the corresponding gain element by the corresponding OR gate. The control signal supplied to the gain element will continue to rapidly decline in amplitude until the output of the gain element is, once again, within acceptable limits. By providing each threshold circuit 108 and 110 with a very rapid overshoot response rate, the amplitude of each source signal will be effectively limited by the constraints set into each threshold circuit. Each threshold circuit will also be provided with a relatively slow recovery rate, however, so as to minimize the distortion introduced by the limiter.

Total modulation constraints are jointly applied to both signal channels via a third OR gate 112, having the same form as gates 104 and 106. OR gate 112 gates control signals generated by two threshold circuits 114 and 116, which respectively determine when total modulation constraints have been exceeded in the in-phase (L+R) and quad-phase (L−R) channels of the composite modulated signal. Threshold circuits 114 and 116 are essentially identical to threshold circuits 108 and 110, except that the threshold levels thereof have been set differently. It will be noted that threshold circuit 114 will preferably be set to allow up to 120% positive modulation, as is now customary in monophonic AM broadcasting. The inputs to threshold circuits 114 and 116 are provided by an audio matrix circuit 118, similar to audio matrix 52 of FIG. 2. If this limiter were employed with the stereo modulator 50 of FIG. 2, audio matrix 118 would, of course, be unnecessary since the inputs to threshold circuits 114 and 116 could be taken directly from audio matrix 52.

Limiter 14 thus applies modulation constraints which prevent over-modulation of the transmitted signal, while still allowing either signal to exceed the 50% modulation level whenever total modulation constraints would not be exceeded thereby. In the illustrated embodiment, each source signal is allowed to provide up to 80% of the total modulation. The modulation constraints provided by the illustrated embodiment, expressed in terms of percent of total allowable modulation, are thus:

$$-80\% \leqq L(t) \leqq +80\%$$
$$-80\% \leqq R(t) \leqq +80\%$$
$$-100\% \leqq (L+R) \leqq +120\%$$
$$-100\% \leqq (L-R) \leqq +100\%$$

The application of these modulation constraints to the left and right signal channels provides a significant improvement in worst case signal-to-noise ratio without impairing the monocompatibility (i.e., distortion) of the system beyond acceptable levels. Even in this case, however, only a narrow range of phase angles may be employed which will provide this acceptable performances. Thus, as the following table indicates, only phase angles in the range of ±10° to ±20° with respect to the carrier signal will provide adequate performance. In TABLE II, the upper number indicates the distortion and the lower number indicates less in SNR, in dB (i.e., Distortion/SNR).

TABLE II

| | | PHASE ANGLE $\theta$ | | | | |
|---|---|---|---|---|---|---|
| | | ±10° | ±12.5° | ±15° | ±17.5° | ±20° |
| Single Channel Max. Mod. | 90% | 2.7/−10 | 3.8/−8.0 | | | |
| | 80% | 1.6/−11 | 2.4/−9 | 3.3/−8 | 4.3/−7 | 5.3/−6 |
| | 70% | | | | 3.0/−8 | 3.8/−7 |

This use of a limiting function of this nature is also desirable from the viewpoint of "loudness" of the mono (L+R) part of the signal. If each channel were only permitted to reach a 50% total modulation level, the mono signal could be as much as 8 dB lower in level, depending upon the nature of the programming material, than the same signal transmitted on a monophonic AM station. Where each channel is allowed to contribute up to 80% of the total modulation, however, a worst case attenuation of only 2 dB will result.

Figure 5:
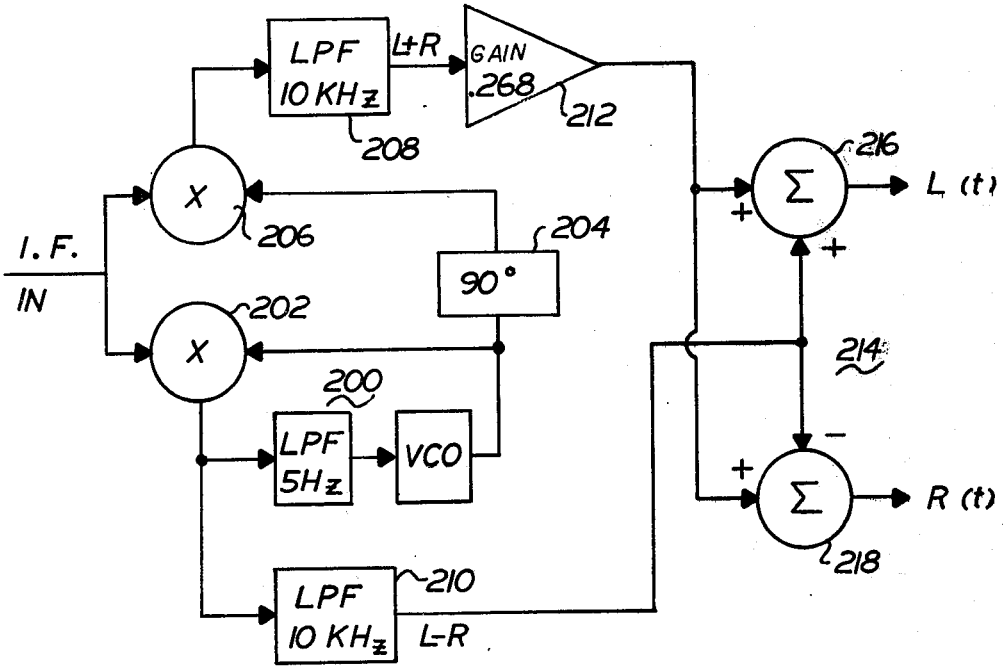

FIG. 5 illustrates a receiving system employing conventional components which may be used for demodulating signal modulated in accordance with the present invention. This receiving system includes a phase lock loop 200 which receives the intermediate frequency signal and regenerates an in-phase carrier signal therefrom. This carrier signal is directly routed to a product detector 202 and indirectly routed via a 90° phase shift circuit 204 to a second product detector 206. Since the carrier supplied to product detectors 202 and 206 are 90° out-of-phase with respect to one another, these detectors detect signals which are in the in-phase and quad-phase channels, respectively. Filters 208 and 210 are included to remove the out-of-band components generated by the product detectors. The output of filter 208 thus comprises the in-phase (L+R) component, whereas the output of filter 210 comprises the quad-phase (L−R) component. The channels must then be corrected for the weighting which was provided by the operation of the stereo modulator back at the transmitter. In the illustrated embodiments a gain circuit 212 is provided in the L−R channel for the purpose of correcting the gain of the L−R component by the ratio of Sin $\theta$ to Cos $\theta$ (i.e., by TAN $\theta$) so as to equalize the amplitudes of the two components. This de-weighting could, of course, be implemental in many other ways. The (L−R) and (L+R) components are supplied to a audio dematrixing circuit 214 comprised of a signal adder 216 and a signal subtractor 218 which recover the L and the R components therefrom.

Although the invention has been described with respect to a preferred embodiment, it will be appreciated that various re-arrangements and alterations of parts may be made without departing from the spirit and scope of the present invention, as defined in the appended claims.

What is claimed is:

1. A compatible multichannel AM modulator, said modulator comprising a source of a first carrier signal, input means for providing first and second source signals and means for modulating said first carrier signal in accordance with said first and second source signals to provide a composite modulated signal having two phase components, the amplitudes of each of which are modulated in accordance with a corresponding one of said first and second signals, said phase components being phased apart from one another by a selected angle, said input means including limiting means for permitting the amplitude of each of said source signals to extend up to, but not exceed, a predetermined level which is greater than 50% of the level which would provide 100% modulation of said composite modulated signal.

2. A compatible multichannel AM modulator for use in a system having both synchronous and nonsynchronous receivers, said modulator comprising a source of a first carrier signal, input means for providing first and second source signals and means for modulating said first carrier signal in accordance with said first and second source signals to provide a composite modulated signal having two phase components, the amplitudes of each of which are modulated in accordance with a corresponding one of said first and second signals, said phase components being phased apart from one another by an angle of no greater than 40° and no less than 20°, whereby said composite modulated signal is compatible for reception by both said synchronous and nonsynchronous receivers, and further comprising limiting means for applying amplitude constraints to said first and second source signals so as to supply said means for modulating with amplitude limited said first and second source signals and comprising individual input channel limiting means for permitting the amplitude of each of said source signals to extend up to, but not to exceed, a predetermined level which is at least 60% and no greater than 90% of the level necessary to provide 100% modulation of said carrier signal, and total modulation limiting means for preventing the total modulation of said carrier signal from exceeding selected total modulation constraints.

3. A compatible multichannel AM modulator as set forth in claim 2, wherein said total modulation limiting means includes means for jointly limiting the amplitudes of each of said first and second source signals so as to prevent overmodulation of said carrier signal.

4. A compatible multichannel AM modulator as set forth in claim 1, wherein said means for modulating said first carrier signal comprises: first modulation means responsive to said first source signal and to a second carrier signal for modulating the amplitude of said second carrier signal in accordance with said first source signal; second modulation means responsive to said second source signal and to a third carrier signal for modulating the amplitude of said third carrier signal in accordance with said second source signal, and signal summing means for additively combining at least said first and second modulated signals so as to thereby provide said composite modulated signal; and, means responsive to said first carrier signal for providing said second and third carrier signals such that said carrier signals all have the same frequency but that said second and third carrier signals are phased apart from one another by an angle of no greater than 40° and no less than 20°.

5. An AM stereo modulation system comprising a source of a first carrier signal, and a stereo modulator for modulating said first carrier signal in accordance with first and second source signals to provide a composite modulated signal having two phase components, the amplitudes of each of which are modulated in accordance with a corresponding one of said first and second source signals, with said phase components being phased at equal phase angles on either side of said first carrier signal by an angle of no greater than 20° and no less than 10°, wherein said stereo modulator comprises matrixing means responsive to said first and second source signals for combining said signals to provide sum and difference signals corresponding respectively to the sum and difference of said first and second source signals; scaling means for scaling the gain of said sum and difference signals in accordance with factors corresponding respectively to Cos $\theta$ and Sin $\theta$, where $\theta$ is no greater than 20° and no less than 10°, so as to provide weighted sum and difference signals, and quadrature modulating means having in-phase and quad-phase modulating channels for quadrature modulating said first carrier signal in said in-phase and quad-phase channels in accordance with said weighted sum and difference signals respectively, to form said composite modulated signal.

6. An AM modulation system for modulating first and second source signals onto a carrier signal comprising: limiter means responsive to said first and second source signals for applying amplitude constraints thereto and including individual channel limiting means for permitting the amplitude of each of said source signals to extend up to, but not to exceed, a predetermined level which is greater than 50% of the level which would provide 100% modulation of said carrier signal, and total modulation limiting means for preventing the total modulation of said carrier signal from exceeding selected total modulation constraints; and, modulating means for amplitude modulating said carrier signal in accordance with the amplitude constrained said first and second source signals to provide a composite amplitude modulated signal.

7. An AM modulator for modulating first and second source signals onto a first carrier signal to provide a composite modulated signal, comprising:

matrixing means for combining said first and second source signals to provide sum and difference signals corresponding respectively to the sum and difference of said first and second source signals;

scaling means for scaling the relative gains of said sum and difference signals in accordance with factors which are respectively proportional to the cosine of a selected phase angle $\theta$ and the sine of said selected phase angle $\theta$ where said selected phase angle $\theta$ is no greater than 20° and no less than 10° so as to respectively provide weighted sum and difference signals;

means for providing said first carrier signal; and, quadrature modulating means for quadrature modulating said first carrier signal in accordance with said weighted sum and difference signals to form a composite modulated signal having in-phase and quad-phase channels, wherein said weighted sum signal is modulated in said in-phase channel and said weighted difference signal is modulated in said quad-phase channel.

8. An AM modulator for modulating first and second source signals onto carrier signals to provide a composite modulated signal, comprising:

input means for providing said first and second source signals, said input means including limiting means for permitting the amplitude of each of said source signals to extend up to, but not exceed, a predetermined level which is greater than 50% of the level which would provide 100% modulation of said composite modulated signal, first modulator means responsive to said first source signal and to a second carrier signal for DSB-SC modulating said second carrier signal in accordance with said first source signal;

second modulator means responsive to said second source signal and to a third carrier signal for DSB-SC modulating said third carrier signal in accordance with said second source signal;

carrier signal generating means for providing first, second, and third carrier signal such that said carrier signals all have the same frequency but that said second and third carrier signals are phased apart by a phase angle of no greater than 40° and no less than 20°; and, signal summing means for additively combining said first and second modulated signals and said first carrier signal so as to thereby provide said composite modulated signal.

9. An AM stereo demodulator for demodulating a composite modulated signal having a carrier component and two phase-shifted components, the amplitudes of which are modulated in accordance with first and second source signals, with said phase components being phased at substantially equal phase angles $\theta$ on either side of said carrier component, where $\theta$ is less than 45°, said demodulator comprising:

a quadrature demodulator responsive to said composite modulated signal for recovering an in-phase component corresponding to the sum of said first and second source signals, and a quad-phase component corresponding to the difference of said first and second source signals;

amplitude adjustment means for adjusting the relative amplitudes of said in-phase and quad-phase components as a function of said phase angle $\theta$; and, signal matrixing means responsive to the amplitude adjusted said in-phase and quad-phase components for adding said components to thereby recover said first source signal and for subtracting said components to thereby recover said second source signal.

10. A compatible multichannel AM modulator as set forth in claim 1, wherein said phase components are phased at substantially equal phase angles of no greater than 20° and no less than 10° on either side of said first carrier signal.

11. An AM modulation system as set forth in claim 6, wherein said predetermined level is at least 60% and no greater than 90% of the level which would provide 100% modulation of said carrier signal.

12. An AM multichannel demodulator as set forth in claim 9, wherein said amplitude adjustment means includes means for adjusting the relative amplitudes of said in-phase and quad-phase components in accordance with the tangent of said phase angle $\theta$.

13. An AM multichannel receiver for demodulating a modulated signal having an unmodulated carrier component and two differently phased modulated carrier components, said receiver comprising: input means for coupling said modulated signal to an AM multichannel demodulator; and AM multichannel demodulator including means for providing a phase reference signal having a predetermined phase relationship with respect to said carrier components of said modulated signal, and a synchronous detector responsive to said modulated signal and to said phase reference signal for synchronously demodulating said modulated signals to recover therefrom first and second signals which have been modulated onto said two modulated carrier components where said two modulated carrier components are phased apart by a phase angles of no greater than 20° and no less than 10° on either side of said unmodulated carrier component; and, means for utilizing said first and second signals, wherein said synchronous detector comprises a quadrature demodulator responsive to said modulated signal and to said phase reference signal for recovering an in-phase component corresponding to the sum of said first and second signals, and a quad-phase component corresponding to the difference of said first and second signals; amplitude adjustment means for adjusting the relative amplitudes of said in-phase and quad-phase components in accordance with the tangent of the phase angle between each of said phase components and said carrier component of said modulated signal; and, signal matrixing means responsive to the amplitude adjusted said in-phase and quad-phase components for selectively combining said components so as to thereby recover said first and second signals therefrom.

14. An AM multichannel communications system comprising:

means for supplying first and second source signals, including limiting means for permitting the amplitude of each of said source signals to extend up to, but not exceed, a predetermined level which is greater than 50% of the level which would provide 100% modulation of said composite modulated signal;

an AM modulator including a source of a first carrier signal, and a multichannel modulator for modulating said first carrier signal in accordance with first and second source signals to provide a composite modulated signal having two phase components, the amplitude of each of which is modulated in accordance with the corresponding one of said first and second source signals, with said phase components being phased apart from one another by an angle of no greater than 40° and no less than 20°;

means for communicating said modulated signal from said AM multichannel modulator to an AM multichannel demodulator;

an AM multichannel demodulator responsive to said modulated signal for recovering said first and second source signal therefrom; and, means for utilizing said first and second source signals as recovered by said AM demodulator.

15. An AM multichannel communications system as set forth in claim 14, wherein said means for communicating said modulated signals from said modulator to said demodulator comprises means for transmitting said modulated signals into free space, and means for recovering said modulated signals from free space and for providing said recovered modulated signals to said demodulator means.

16. An AM multichannel modulation system as set forth in claim 14, wherein said AM demodulator comprises means for providing a phase reference signal having a predetermined phase relationship with respect to said carrier component of said modulated signal, and a synchronous detector responsive to said modulated signal and to said phase reference signal for synchronously demodulating said modulated signals so as to recover therefrom said first and second source signals.

17. An AM communications system comprising:

input means for providing first and second source signals, said input means including limiting means for permitting the amplitude of each of said source signals to extend up to, but not exceed, a predetermined level which is greater than 50% of the level which would provide 100% modulation of said composite modulated signal, transmitter means for transmitting a composite modulated signal having two differently phased modulated carrier components, the amplitude of each of which is modulated in accordance with a corresponding one of said first and second source signals, said components being phased apart from one another by a predetermined phase angle;

first receiver means for receiving said composite modulated signal and responsive to only the envelope thereof for providing a monophonic demodulated signal; and, second receiver means for receiving said composite modulated signal and for detecting said first and second modulated components thereof so as to thereby independently recover said first and second source signals;

wherein said predetermined phase angle is selected to be no greater than 40° and no less than 20° so that said monophonic signal recovered by said first receiver means will correspond closely to the sum of said first and second source signals, and yet said source signals may be independently recovered by said second receiver means with high fidelity.

18. An AM stereo demodulator as set forth in claim 9, wherein said phase angles $\theta$ are substantially fixed and said amplitude adjustment means includes means for providing a substantially fixed adjustment of the relative amplitudes of said in-phase and quad-phase components in accordance with said fixed phase angle $\theta$.

19. An AM stereo demodulator as set forth in claim 18, wherein said phase angles $\theta$ are substantially equal to 15° and wherein said means for providing a substantially fixed adjustment comprises means for providing a substantially fixed adjustment of the relative amplitudes of said in-phase and quad-phase components in accordance with said 15° phase angle.

20. An AM stereo demodulator for demodulating a composite modulated signal having a carrier component and two phase-shifted components, the amplitudes of which are modulated in accordance with first and second source signals, with said phase components being phased at substantially equal phase angles on either side of said carrier component, said demodulator comprising:

a quadrature demodulator responsive to said composite modulated signal for recovering an in-phase component representative of the sum of said first and second source signals, and a quad-phase component representative of the difference of said first and second source signals;

amplitude adjustment means for adjusting the relative amplitudes of said in-phase and quad-phase components as a function of said phase angle; and, signal matrixing means responsive to the amplitude adjusted said in-phase and quad-phase components for adding said components to thereby recover said first source signal and for subtracting said components to thereby recover said second source signal.

21. An AM stereo demodulator as set forth in claim 20, wherein said phase angles are substantially fixed and said amplitude adjustment means includes means for providing a substantially fixed adjustment of the relative amplitudes of said in-phase and quad-phase components in accordance with said fixed phase angle.

22. An AM stereo demodulator as set forth in claim 21, wherein said phase angles are substantially equal to 15° and wherein said means for providing a substantially fixed adjustment comprises means for providing a substantially fixed adjustment of the relative amplitudes of said in-phase and quad-phase components in accordance with said 15° phase angle.

* * * * *